US007562690B1

(12) United States Patent
Loweth

(10) Patent No.: US 7,562,690 B1
(45) Date of Patent: Jul. 21, 2009

(54) SUSPENDED BED TENT

(76) Inventor: Janine M Loweth, 4 Red Oak Ter., Oak Ridge, NJ (US) 07438

( * ) Notice: Subject to any disclaimer, the term of this patent is extended or adjusted under 35 U.S.C. 154(b) by 533 days.

(21) Appl. No.: 11/375,858

(22) Filed: Mar. 15, 2006

(51) Int. Cl.
*A47H 1/00* (2006.01)

(52) U.S. Cl. ..... 160/330; 160/349.1; 160/368.1; 5/414; 135/96

(58) Field of Classification Search ..... 160/330, 160/349.1, 368.1, 382; 16/87.2; 5/414, 113, 5/658; 24/113 R, 113 MP, 105; 248/317, 248/342, 343; 411/507, 372.5, 372.6, 373, 411/374, 429, 431, 311, 396, 397; 52/39; 135/90, 96
See application file for complete search history.

(56) References Cited

U.S. PATENT DOCUMENTS

| | | | | | |
|---|---|---|---|---|---|
| 87,589 | A | | 3/1869 | Platt | |
| 654,156 | A | * | 7/1900 | Johnson | 135/90 |
| 671,912 | A | * | 4/1901 | Woodward | 135/90 |
| 808,867 | A | * | 1/1906 | Perry | 40/1.5 |
| 817,536 | A | * | 4/1906 | Wendling | 24/105 |
| 1,014,848 | A | | 1/1912 | Reinert | |
| 1,176,619 | A | * | 3/1916 | Sykes | 24/694 |
| 1,283,111 | A | * | 10/1918 | Doran | 24/105 |
| 1,370,319 | A | * | 3/1921 | Kennedy | 411/341 |
| 1,565,191 | A | | 12/1925 | Nelson | |
| 1,776,096 | A | * | 9/1930 | Alland | 24/105 |
| 1,793,712 | A | * | 2/1931 | Morehouse | 24/105 |
| 1,831,169 | A | * | 11/1931 | Geraldine | 24/1 |
| 1,892,378 | A | | 12/1932 | Bernstein | |
| 1,897,196 | A | * | 2/1933 | Hunt | 411/389 |
| 1,927,061 | A | * | 9/1933 | Chapman | 24/1 |
| 2,107,885 | A | * | 2/1938 | Caggiano | 248/223.41 |
| 2,210,799 | A | * | 8/1940 | Denny | 160/349.2 |
| 2,357,056 | A | | 8/1944 | Nelson | |
| 2,584,224 | A | * | 2/1952 | Pfaffko | 160/349.2 |
| 2,584,828 | A | * | 2/1952 | Ballou, Jr. | 24/105 |
| 2,931,373 | A | | 4/1960 | Larson | |
| 3,170,361 | A | * | 2/1965 | Vaughn | 411/341 |
| 3,578,003 | A | | 5/1971 | Everett | |
| 3,967,348 | A | * | 7/1976 | Rogen | 24/114.05 |
| 4,237,914 | A | | 12/1980 | Gantz | |
| 4,607,401 | A | * | 8/1986 | Sisson | 5/414 |
| 4,682,447 | A | * | 7/1987 | Osborn | 52/3 |
| 4,729,137 | A | * | 3/1988 | Denney | 135/121 |
| 4,785,837 | A | * | 11/1988 | Hansen et al. | 135/90 |
| 4,912,829 | A | * | 4/1990 | Hickey | 29/453 |
| 5,010,625 | A | * | 4/1991 | Joyer | 24/90.1 |
| 5,074,730 | A | * | 12/1991 | Duran | 411/403 |

(Continued)

FOREIGN PATENT DOCUMENTS

| | | |
|---|---|---|
| EP | 0085270 | 8/1983 |

(Continued)

*Primary Examiner*—Katherine W Mitchell
*Assistant Examiner*—Jaime F Cardenas-Garcia
(74) *Attorney, Agent, or Firm*—Michael I. Kroll

(57) ABSTRACT

Apparatus 10 discloses a bed 14 curtain 12 comprising fabric suspended from a plurality of attachments 18 attached to the ceiling 40 encompassing a bed 14, wherein the fabric includes grommeted apertures 48 for engaging the attachments. The apparatus 10 provides a decorative and concealing curtain 12 around a mattress or bedding area 14 suspended from the ceiling 40 at the corners 56 by anchors 34 for attaching the grommets 22 located in the fabric's corners to the anchors.

11 Claims, 13 Drawing Sheets

U.S. PATENT DOCUMENTS 5,214,811 A * 6/1993 Priem ..... 5/655.6
5,426,828 A * 6/1995 Kusano ..... 24/105
5,577,359 A * 11/1996 McClanahan ..... 52/291
5,718,254 A * 2/1998 Murphy ..... 135/96
5,769,144 A * 6/1998 Carter ..... 160/330
5,836,330 A * 11/1998 Franklin ..... 135/90
6,015,004 A * 1/2000 Harkinson ..... 160/349.1
6,145,141 A 11/2000 Whittington et al.
6,317,910 B1 * 11/2001 Wilson ..... 5/658
6,752,164 B1 6/2004 Park

FOREIGN PATENT DOCUMENTS

GB 444761 3/1936
WO WO87/06293 10/1987

* cited by examiner

SUSPENDED BED TENT

BACKGROUND OF THE INVENTION

1. Field of the Invention

The present invention relates generally to tents and, more specifically, to a bed tent comprising fabric suspended from a plurality of anchors encompassing a bed, wherein said fabric includes grommeted apertures for engaging said anchors. The present invention provides a decorative and concealing curtain around a mattress or bedding area suspended from the ceiling at the corners by anchors providing means for attaching the grommets located in the fabric's corners to the anchors.

The anchors are secured to the ceiling at the proximal corners of the bed forming a partition encompassing the bedding area serving as a hanging decorative curtain providing added privacy and aesthetic value to a bed.

To attach the bed tent to the ceiling, a plurality of anchors are inserted into a ceiling either as threaded screw fastener or toggle bolt fixedly positioned with washer and nut or similar fastener resulting in a threaded support depending from the ceiling whereby the grommeted fabric is inserted over the threaded support with the button-like attachment's rotative threaded receiver placed into engagement with the threaded support. Rotation of the receiver through the externally provided aperture, such as by screwdriver, threads the receiver onto the support crimping the grommet and fabric between the ceiling and decorative button-like attachment. Also provided is a cap insertable into the attachment aperture closing said aperture. Additionally, the present invention provides for an additional element in the form of tassels that can also extend from the fascia notch adding a decorative element to the bed tent anchors. Other decorative elements could be attached to the button-like anchors using the fastener post as means for attachment.

2. Description of the Prior Art

There are other devices designed for tents. Typical of these is U.S. Pat. No. 87,589 issued to Platt on Mar. 9, 1869.

Another patent was issued to Reinert on Jan. 16, 1912 as U.S. Pat. No. 1,014,848. Yet another U.S. Pat. No. 1,565,191 was issued to Nelson on Dec. 8, 1925 and still yet another was issued on Dec. 27, 1932 to Bernstein as U.S. Pat. No. 1,892,378.

Another patent was issued to Nelson on Aug. 29, 1944 as U.S. Pat. No. 2,357,056. Yet another U.S. Pat. No. 2,931,373 was issued to Larson on Apr. 5, 1960. Another was issued to Everett on May 11, 1971 as U.S. Pat. No. 3,578,003 and still yet another was issued on Dec. 9, 1980 to Gantz as U.S. Pat. No. 4,237,914.

Another patent was issued to Denney on Mar. 8, 1988 as U.S. Pat. No. 4,729,137. Yet another U.S. Pat. No. 5,718,254 was issued to Murphy on Feb. 17, 1998. Another was issued to Whittington, et al. on Nov. 14, 2000 as U.S. Pat. No. 6,145,141 and still yet another was issued on Jun. 22, 2004 to Park as U.S. Pat. No. 6,752,164.

Another patent was issued to MacKay on Mar. 25, 1936 as U.K. Patent No. GB444,761. Yet another European Patent Application No. EP 0085270 was issued to Phillips on Aug. 10, 1983. Another was issued to Khadivi on Oct. 22, 1987 as International Patent Application No. WO87/06293.

U.S. Pat. No. 87,589

Inventor: Jacob B. Platt

Issued: Mar. 9, 1869

A bed, tent, or mosquito-bar canopy, having one or more covered openings in or through it, and suitable appliances by which they can be opened or uncovered, so that any insects inside of the bar may be driven out or allowed to escape through such openings, substantially as and for the purpose described.

U.S. Pat. No. 1,014,848

Inventor: Peter J. Reinert

Issued: Jan. 16, 1912

A crib comprising a substantially rectangular-shaped frame, including side and end bars, each being provided with a groove disposed in its outer face longitudinally thereof, a canvas sheet disposed across said frame, means detachably securing the edges of the sheet in the grooves in the side and end bars, and a removable cover having its edges wrapped about the side and end bars and held connected thereto by the sheet when supporting an infant.

U.S. Pat. No. 2,565,191

Inventor: Virginia P. Nelson

Issued: Dec. 8, 1925

A device of the character described, comprising a post adapted to be secured to a bed, an arm on the upper end of the post, a canopy holder removably connected to the arm and comprising a collapsible spider, couplings at the ends of the spider members, and flexible strips interposed between the couplings and at their ends engaging the couplings and forming a circular member.

U.S. Pat. No. 1,892,378

Inventor: Sarah E. Bernstein

Issued: Dec. 27, 1932

A tent adapted to enclose a bed and supported solely thereby, comprising two sections, a head section secured to the head of the bed and a foot section secured to the foot of the bed, means for detachably connecting the two sections along a line nearer the head than the foot of the bed, one of said sections having a ventilating aperture, and said tent having means for communicating with the outside.

U.S. Pat. No. 2,357,056

Inventor: Virginia P. Nelson

Issued: Aug. 24, 1944

A socket and loop for canopies having bows and comprising a vertical portion having a pair of clip arms extending in vertically spaced relation from said vertical portion in one direction, angled socket portions extending vertically of said vertical portion and having their proximal edges spaced, said socket portions being adapted to receive the bottom end of a bow, stop means extending inwardly of the angled portion to limit downward movement of the bow, inwardly opening hook means extending outwardly from the lower ends of the angled portions, and a loop securable to a canopy web and engageable in said hook means.

U.S. Pat. No. 2,931,373

Inventor: Dean W. Larson

Issued: Apr. 5, 1960

A shelter comprising a pair of planar, opposed side walls, a pair of planar, opposed end walls; a planar top member and a planar bottom member, all interconnected to form a unitary, box-like body; presenting a plurality of corners at the periphery of the top member; means for suspending said body—from said corners, the body being adapted to confine a sleeping bag therein when in the operative condition—and with the bag superimposed upon said bottom member; and a single, L-shaped slide fastener having a horizontal leg and a vertical leg and connecting one side wall with one end wall at their proximal edges and said one side wall with said bottom member—whereby to set off an entrance flap, swingable upwardly at an angle along a line joining the ends of said L-shaped fastener, toward the top when the slide fastener is open, said pair of planar, opposed side walls, said pair of planar, opposed end walls and said top member being provided with a snug cover of water-proof material, said cover having a central portion of substantially the same area as said top member, a pair of opposed side panels each of substantially the same area as the said side walls respectively, and a pair of opposed end panels each of substantially the same area as said end walls respectively, and interconnecting fasteners at the meeting edges of each of said side panels and the end panels.

U.S. Pat. No. 3,578,003

Inventor: Lucille G. Everett

Issued: May 11, 1971

A portable platform and a compact tentlike shelter providing a safe, cozy, comforting and snug hiding place for a child. The platform is characterized by a low-lying rigid but lightweight frame suspending a canvas floor. Both ends of the tent embody readily openable and closable flaps having suitable flap-tying tapes which permit the child to crawl through, back and forth at will. The applicable and removable tent material is washable, is draped over a rigid shaped-imparting framework and the lower lengthwise edges are preferably provided with anchorable holddown straps. Thus and amply ventilated, this unique shelter permits concealment, prevents stuffiness and permits playful freedom for the child.

U.S. Pat. No. 4,237,914

Inventor: Emmett J. Gantz

Issued: Dec. 9, 1980

A portable folding tent which is adapted to be erected over a child's bed thereby enabling the child to camp out under a tent in his own bed. Several basic embodiments of the tent are provided. One has substantially rigid sides, while another includes a light tubular frame with a soft cover stretched thereover and secured thereto. The rigid sided embodiment may be reversible and have different figurines or decorations on the side walls thereof. Another embodiment may provide for inflatable tent sides so that the structure may be utilized as either a tent or a floatable raft. Other features include a hinged top in combination with an adjustable member for setting the width of the tent to any desired angle. Anchor straps attach to the lower portion of the tent and may be used to secure the tent to the bed or ground.

U.S. Pat. No. 4,729,137

Inventor: Carmen T. Denney

Issued: Mar. 8, 1988

A bed canopy support and assembly are provided wherein the assembly is comprised of four supports fastened together in a rectangular configuration. Each support includes a channel-shaped valance support member defining upper and lower substantially parallel and opposed flanges and a connecting element extending between and at substantially right angles with the flanges, and a substantially L-shaped drapery and canopy support member integral with and projecting downwardly from and at substantially a right angle with the lower flange. Hook and loop type fastener material, such as Velcro, are provided on each support for attaching a valance drapery and canopy to the support.

U.S. Pat. No. 5,718,254

Inventor: David A. Murphy

Issued: Feb. 17, 1998

An adjustable bed canopy and curtain system including a sheet of fabric, at least four vertical post and a frame member. The frame member has a first pair of "L" shaped tubular members and a second pair of "L" shaped tubular members. Each of the first and second pair of "L" shaped tubular members have a lower elongated portion and an upper elongated portion. Each of the first and second pair of "L" shaped tubular members have a horizontal bar projecting from one of the lower elongated portions and capable of coupling with a horizontal bar of another of the lower elongated portions. The upper elongated portion, of each of the first pair of tubular members, receives the upper elongated portions of the second pair of tubular members when the horizontal bars of each tubular member are coupled. Each of the lower elongated portions, of each of the first and second tubular members, are positioned over one of the four vertical post when the first and second pair of tubular members are coupled. The sheet of fabric is positioned over the coupled first and second tubular members.

U.S. Pat. No. 6,145,141

Inventor: Dale Whittington, et al.

Issued: Nov. 14, 2000

A portable mosquito net apparatus is formed of a frame, adapted to be sandwiched between a bed mattress and a mattress support surface, typically a mattress spring, and is held in place by the weight of the mattress. The frame mounts a mosquito net support to which a mosquito net is attached in a position over the mattress. The mosquito net is draped down about the edges of the mattress to form an enclosed space. The frame, mosquito net support, and mosquito net can be easily disassembled for storage or transport in a small luggage bag.

U.S. Pat. No. 6,752,164

Inventor: Wan Joo Park

Issued: Jun. 22, 2004

The invention discloses an indoor tent encompassing the space in a room designed to change the atmosphere of a child's room or play room having preprinted characters and the ability whereby users can create interchangeable themes. The room-tent has a zippered access panel functioning as a door that functions from the interior and the exterior. A window is provided to allow air and sunlight to enter the structure and has attached curtains. An opening is also provided for either a viewing port or access port and can also be provided with curtains. A cargo net is attached to the ceiling portion of the interior of the tent. Objects such as clothes, books, magazines, towels and other goods are stored away and easily access. Hook and loop attachable picture frames are also provided. The frames are designed so that the pictures can be interchangeable with the design of the tent. The picture frames are fixedly attached to the tent wall by means of hook and loop fasteners.

U.K. Patent Number GB444,761

Inventor: Alister M. MacKay

Issued: Mar. 25, 1936

A tent framing is fitted to one or both of the side frame-members 13 of a bed &c. by means of brackets 11, the extended portions of which form the sole support for the associated wall of the tent. The brackets are shaped to slope downwards away from the bed. The tent-framing is formed in collapsible sections, the end members being secured to the bed &c. by clamps 12. Canvas flaps 33, with or without gauze portions 34 for ventilation, may be secured to the frame-members 13, 16. To provide for shrinkage of the tent cover, one end is provided with a bight or loop 26 which is bridged by a strip 27 of elastic material.

European Patent Application Number EP 0085270

Inventor: William E. Phillips

Published: Aug. 10, 1983

A bed/shelter unit comprising a lightweight air mattress and a lightweight tent on the mattress adapted to be erected as a shelter over the mattress and to be collapsed on the mattress, the mattress, when deflated, and the tent, when collapsed on the mattress, being adapted to be compactly packed as by rolling them up into a lightweight bundle. The tent comprises a panel of lightweight flexible tent material adapted to arch over the inflated mattress from one side thereof to the other, the panel having inflatable arches at its ends adapted when inflated to extend over the mattress from one side to the other. End closures at the ends of the tent hold the arches in an erected position with the panel drawn between the arches and thereby arched over the mattress.

International Patent Application Number WO 87/06293

Inventor: Homayoun Khadivi

Issued: Oct. 22, 1987

Canopy and method of making thereof, for new use of preventing injuries and saving lives, comprising a top (51, 101), impact resistant cover (55, 104), vertical means for supporting the top (58, 94, 102) and a base (59, 105). The cover, comprising beams (50, 52, 100), rod members (54) and impact resisting material (56, 90). The impact resisting material is secured to the rod members. The rod members are connected to the beams. The beams are substantially rigidly connected to the vertical means, for transferring the load and impact of falling objects and construction material. The base, comprising base beams (60, 62, 96, 106, 108) are connected to the vertical means for transferring and spreading the load and impact of falling objects and construction material and providing integrity. The connection of beams to vertical means comprises a support arm (64, 110), which fits inside the beam or the vertical means and is welded to the vertical means or the beams. The substantially rigid connections provide the required lateral stability, integrity and sturdiness. The detachable connections ease the transportation and assembly.

While these devices may be suitable for the purposes for which they were designed, they would not be as suitable for the purposes of the present invention, as hereinafter described.

SUMMARY OF THE PRESENT INVENTION

The present invention discloses a bed curtain comprising fabric suspended from a plurality of anchors encompassing a bed, wherein the fabric includes grommeted apertures for engaging the anchors. The present invention provides a decorative and concealing curtain around a mattress or bedding area suspended from the ceiling at the corners by anchors providing means for attaching the grommets located in the fabric's corners to the anchors. A plurality of button-like attachment anchors are used to attach the curtain to the ceiling around the bed.

A primary object of the present invention is to provide a bed tent comprising fabric suspended from a plurality of anchors encompassing a bed.

Another object of the present invention is to provide a bed tent wherein said fabric includes grommeted apertures positioned approximate four corners whereby fabric can be suspended therefrom.

Yet another object of the present invention is to provide a bed tent wherein the fabric walls having a centrally positioned slit extending upward so that the fabric can be gathered at one or more corners and contained there by a fabric cinching method.

Still yet another object of the present invention is to provide a bed tent a decorative and concealing curtain around a mattress or bedding area suspended from the ceiling at the corners.

Additional objects of the present invention will appear as the description proceeds.

The present invention overcomes the shortcomings of the prior art by providing a bed tent comprising fabric suspended from a plurality of anchors encompassing a bed, wherein said fabric includes grommeted apertures for engaging said anchors. The present invention provides a decorative and concealing curtain around a mattress or bedding area suspended from the ceiling at the corners by anchors providing means for attaching the grommets located in the fabric's corners to the anchors. Typically, the anchors are secured to the ceiling at the proximal corners of the bed forming a partition encompassing the bedding area serving as a hanging decorative curtain providing added privacy and aesthetic value to a bed.

To attach the bed tent to the ceiling, a plurality of anchors are inserted into a ceiling either as threaded screw fastener or toggle bolt fixedly positioned with washer and nut or similar fastener resulting in a threaded support depending from the ceiling whereby the grommeted fabric is inserted over the threaded support with the button-like attachment's rotative threaded receiver placed into engagement with the threaded support. Rotation of the receiver through the externally provided aperture, such as by screwdriver, threads the receiver onto the support crimping the grommet and fabric between the ceiling and decorative button-like attachment. Also provided is a cap insertable into the attachment aperture closing said aperture. Additionally, the present invention provides for an additional element in the form of tassels that can also extend from the fascia notch adding a decorative element to the bed tent anchors. Other decorative elements could be attached to the button-like anchors using the fastener post as means for attachment.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
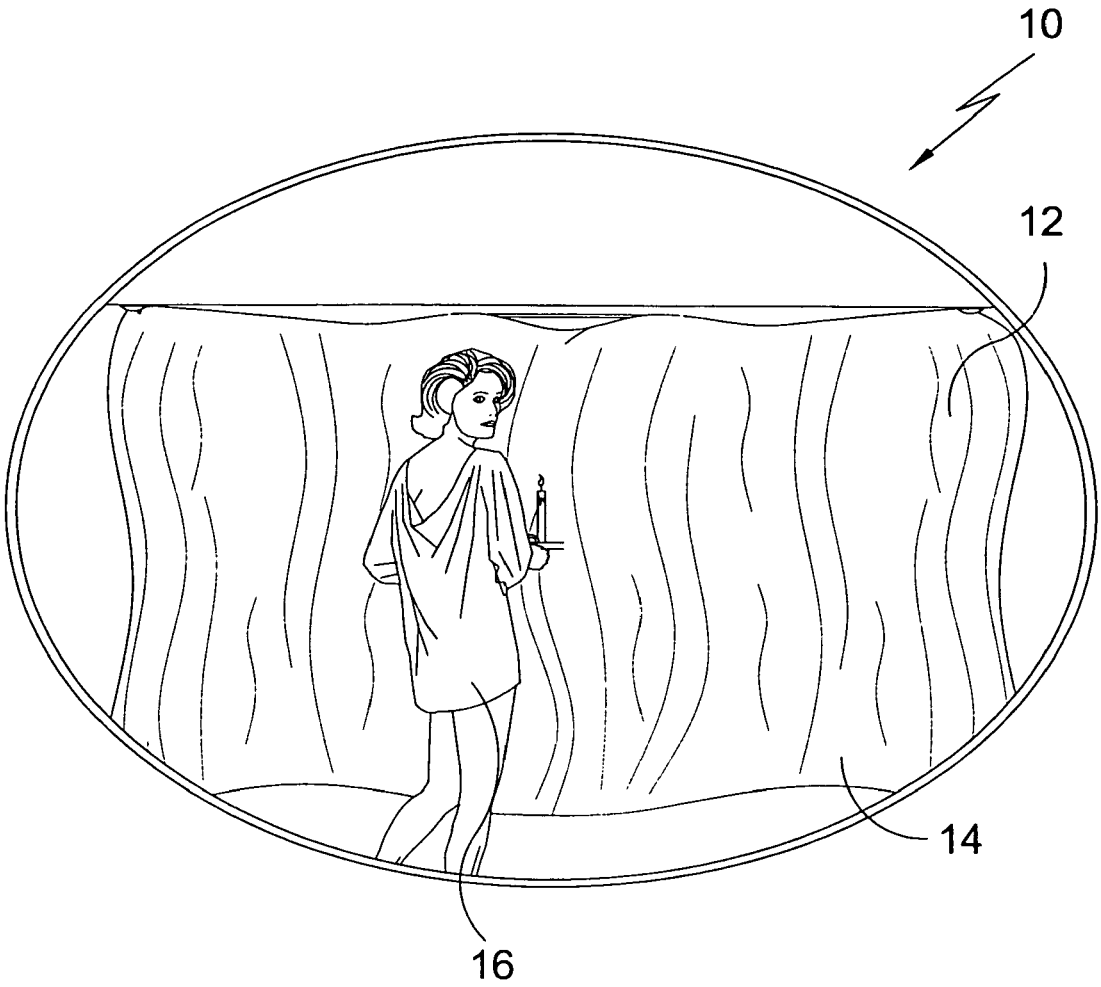
FIG. 1 is an illustrative view of the present invention in use.

With regard to reference numerals used, the following numbering is used throughout the drawings.

10 present invention
12 curtain
14 bed
16 user
18 button-like attachment
20 top of curtain
22 grommet
24 rotative post
25 bore of receiver
26 front
28 rear
30 cap
32 slotted head
34 anchor
36 washer
38 nut
39 ceiling joist
40 ceiling
41 sheetrock
42 support
44 toggle bolt
45 screws
46 spacer
48 aperture
50 ball and tassel
52 loop
54 stem
56 corners
58 open seam
62 tie back tassel
64 flange
66 housing

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use by a user 16. Shown is the bed tent of the present invention 10 comprising a fabric curtain 12 suspended from a plurality of anchors encompassing a bed 14, wherein the fabric includes grommets for engaging the anchors. The present invention 10 provides a decorative and concealing curtain 12 around a mattress or bedding area 14 suspended from the ceiling at the corners by anchors providing means for attaching the grommets located in the fabric's corners to the anchors.

Figure 2:
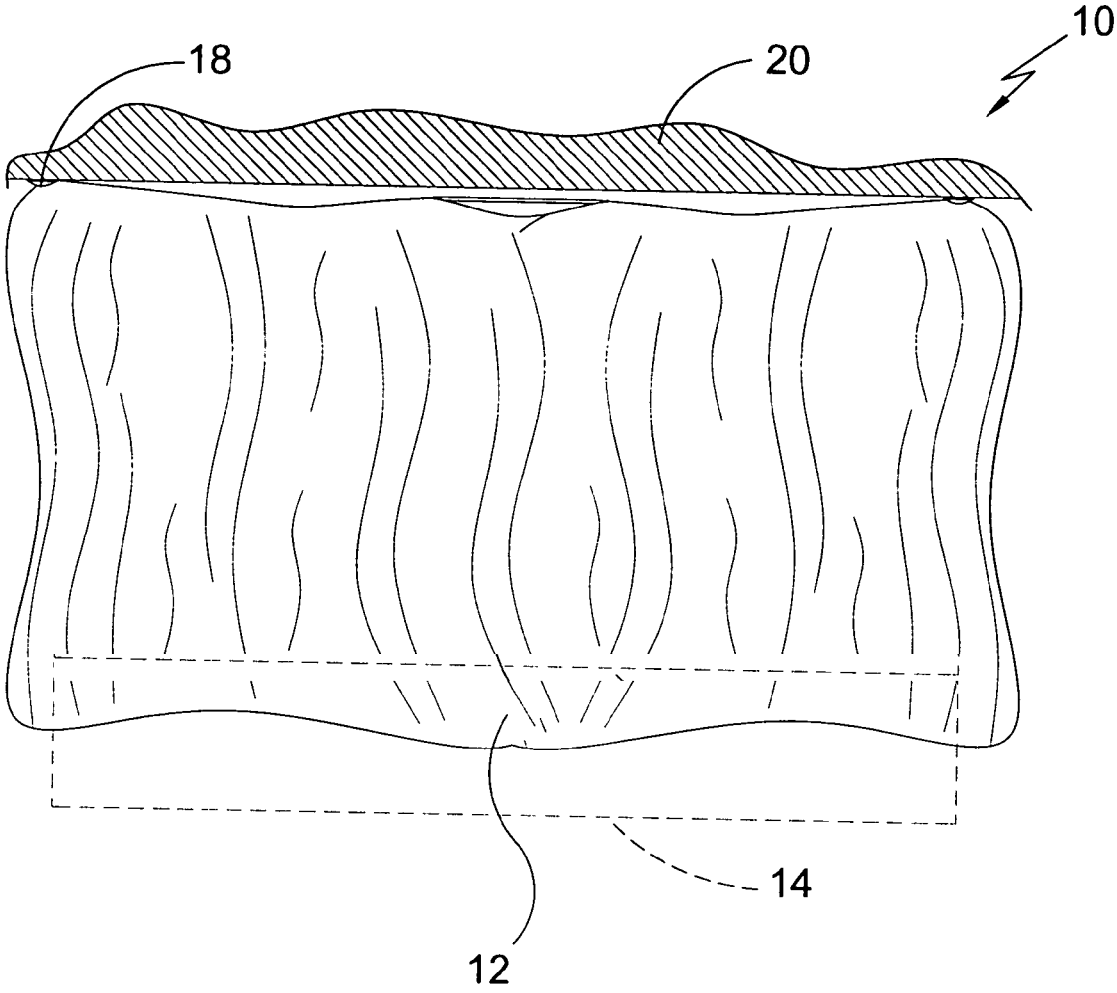
FIG. 2 is a side view of the present invention.

Turning to FIG. 2, shown therein is a side view of the present invention 10. Shown is the bed tent of the present invention 10 comprising a fabric curtain 12 forming the walls with grommets fastened to button-like attachments 18 secured to the ceiling 20 at the proximal corners of the bed 14 forming a partition encompassing the bedding area serving as a hanging decorative curtain providing added privacy and aesthetic value to a bed.

Figure 3:
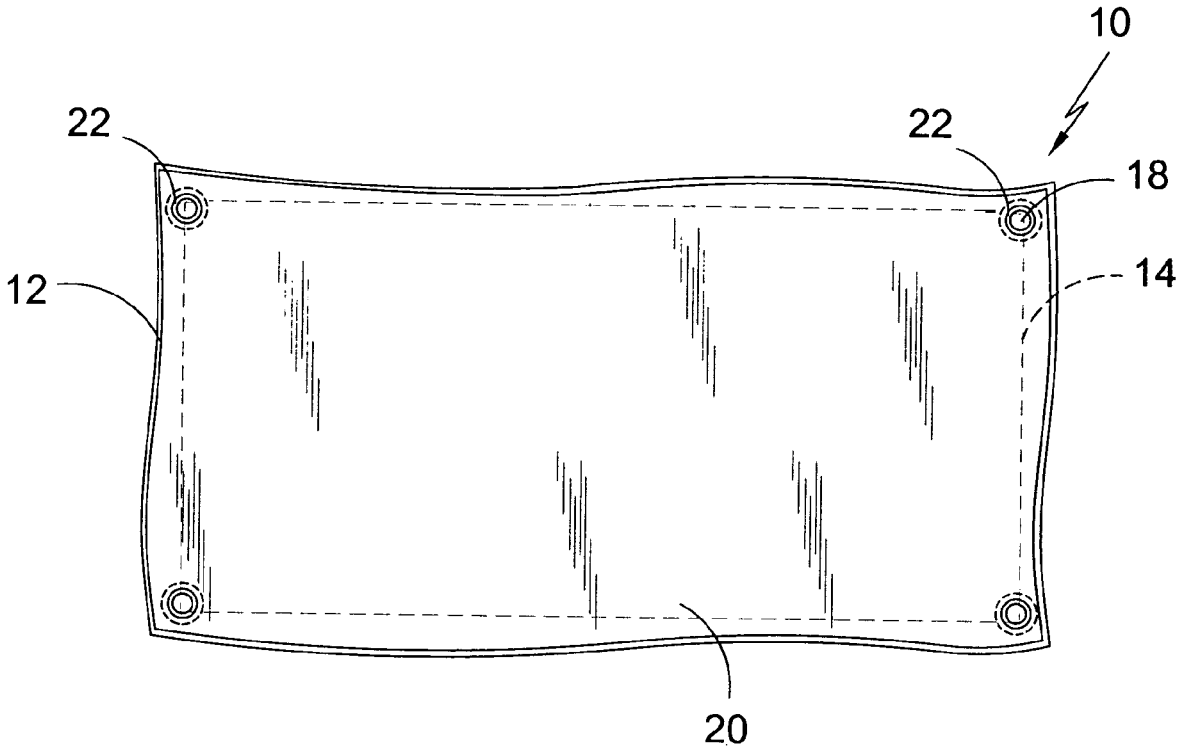
FIG. 3 is a top view of the present invention.

Turning to FIG. 3, shown therein is a top view of the present invention 10. Shown is a top view of the present invention 10 showing how the button like attachments 18 are placed in the ceiling at the outside proximate corners of the bed 14 to allow for the curtain 12 to be suspended around the periphery of the bed. Also shown are the top 20 of curtain 12 and the grommet 22.

Figure 4:
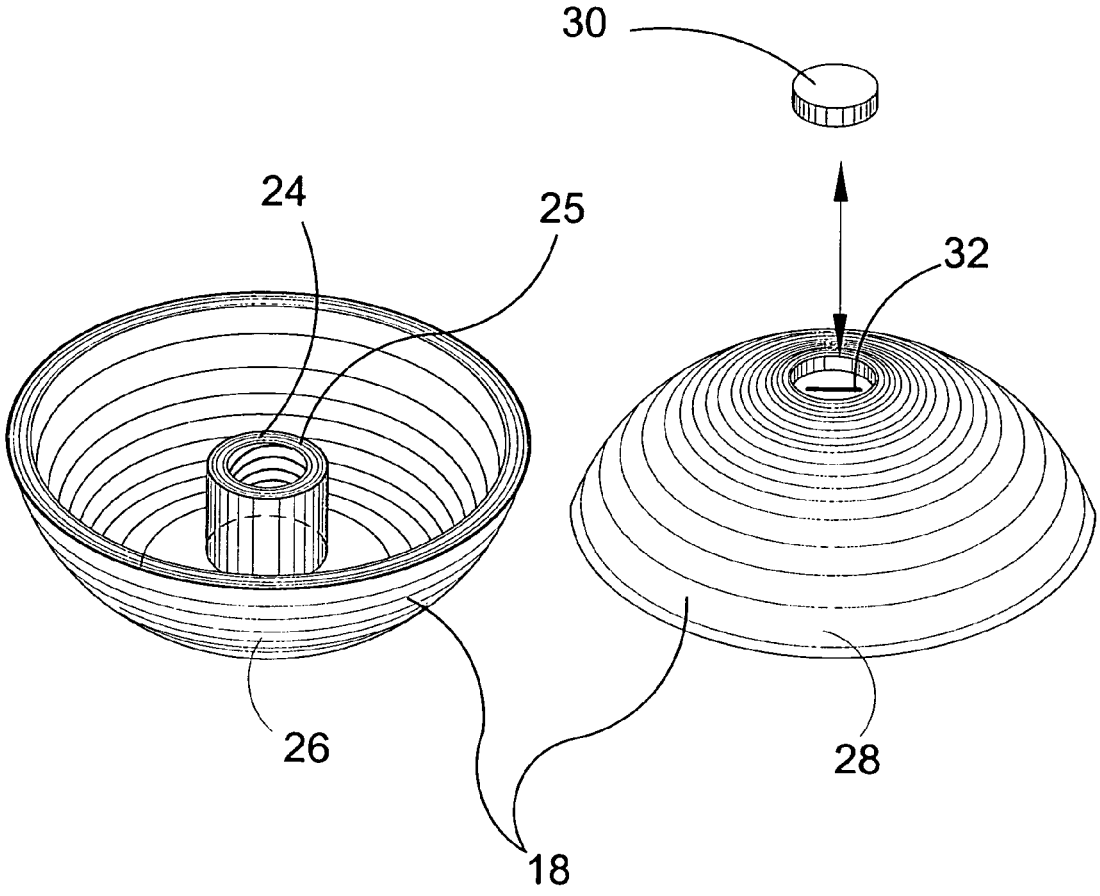
FIG. 4 is a perspective view of the button-like attachments of the present invention.

Turning to FIG. 4, shown therein is a perspective view of the button-like attachments 18 of the present invention. Shown is the anchor fascia element having a bowl-like form with a centrally disposed rotative post 24 with a threaded bore 25 for receiving the anchor bolt having the anchor fastener attached thereto. The anchor fascia post provides means for attaching fabric sheets by grommets located along the fabric body. Also shown are the front 26, rear 28 and cap 30 with slotted head 32 of the post 24.

Figure 5:
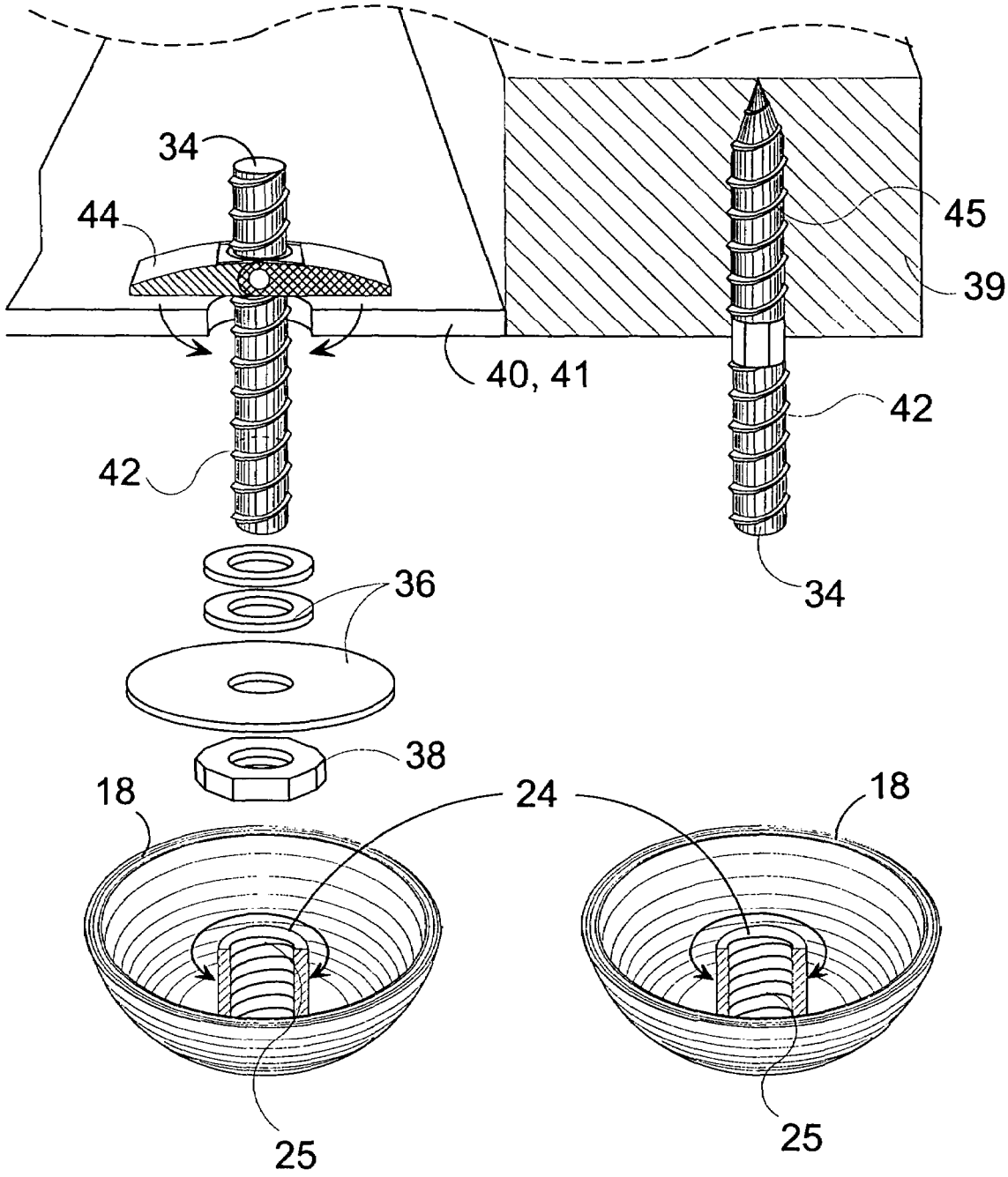
FIG. 5 is a perspective view of one embodiment of the anchor of the present invention.

Turning to FIG. 5, shown therein is a perspective view of a typical anchor of the present invention. Shown is the button-like attachment 18 of the present invention having a form that provides a means of hanging the fabric from the ceiling. To attach the bed tent to the ceiling, an anchor 34 of the toggle bolt 44 or screws 45 is inserted into the ceiling 40 sheetrock 41 or wooden ceiling joist 39 and fixedly positioned with washers 36 and nut 38 or similar fastener resulting in a downwardly threaded support 42 depending from the ceiling whereby the grommeted fabric is inserted over the threaded support 42 with the button-like attachment's rotative threaded receiver bore 25 placed into engagement with the threaded support 42. Rotation of the post 24 through the externally provided aperture, such as by screwdriver, threads the post 24 onto the support 42 crimping the grommet and fabric between the ceiling 40 and decorative button-like attachment 18. Also provided is a cap insertable into the attachment aperture closing the aperture.

Figure 6:
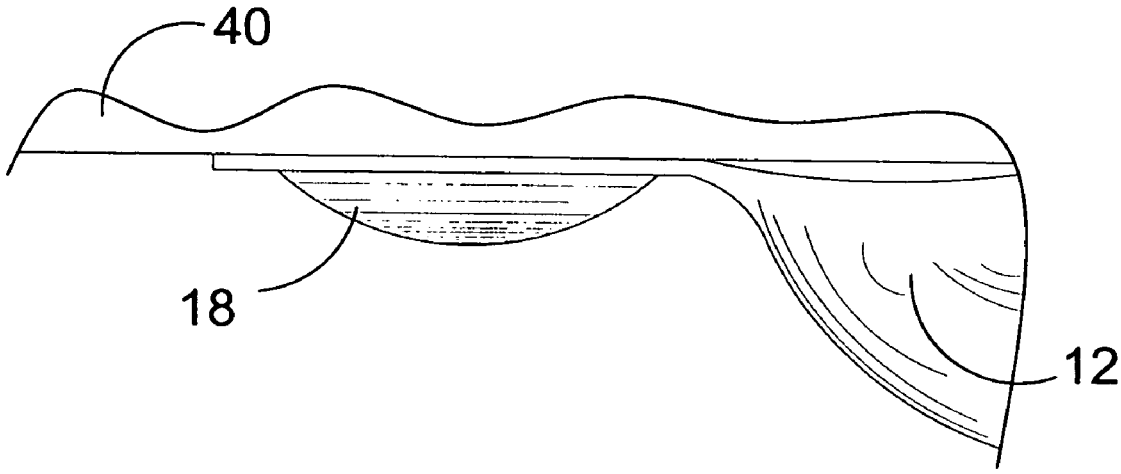
FIG. 6 is a side view of the button-like attachment of the present invention.

Turning to FIG. 6, shown therein is a side view of the button-like attachment 18 of the present invention. Shown is one of the button-like attachments 18 that form the anchor elements whereby the bed tent walls or curtains 12 are secured to the ceiling 40 by means of grommets. To attach the bed tent walls to the anchors, a grommet is placed over the threaded support prior to threadedly attaching the fastener fascia element to the anchor bolt. Additionally, the present invention provides for an additional element in the form of tassels that can also extend from the fascia adding a decorative element to the bed tent anchors. Other decorative elements could be attached to the button-like anchors using the threaded support as means for attachment.

Figure 7:
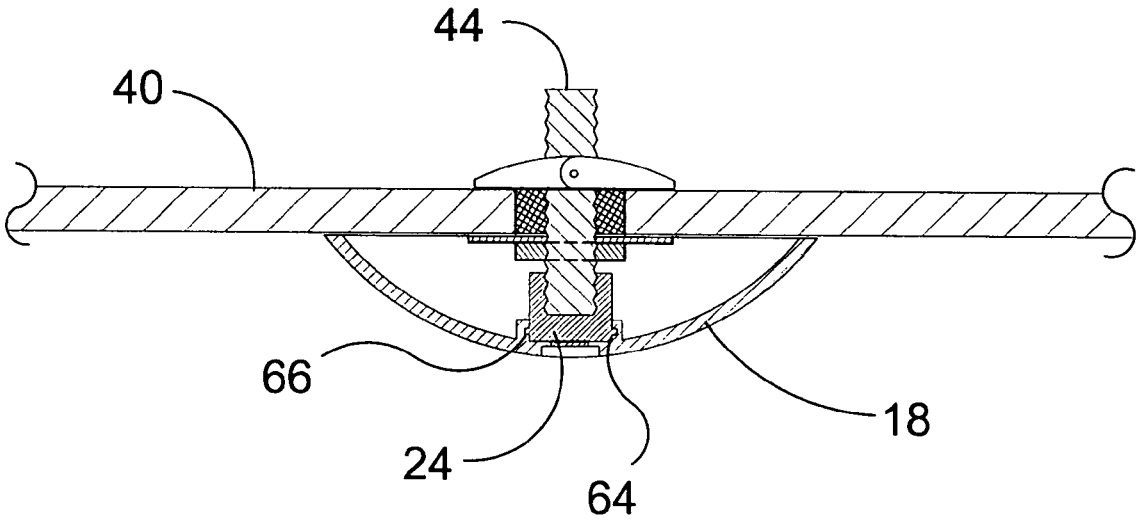
FIG. 7 is a side sectional view of the button-like attachments of the present invention.

Turning to FIG. 7, shown therein is a side sectional view of one of the button-like attachments 18 of the present invention. Shown is a button-like attachment 18 of the present invention providing means for suspending a fabric tent-like curtain from a ceiling 40. To attach the bed-tent fabric a plurality of grommeted apertures are provided with the fabric at predetermined locations proximate the four corners of the article being provided with the fabric-tent. Strategically placed slits extending partially up the fabric provides means for access when completely encompassing the article or draping the fabric valance-like with tiebacks. Also shown are rotative post 24 and toggle bolt 44. The post 24 has a flange 64 thereon which rotatably mates to and rotates in a housing 66 on the upper face of attachment 18.

Figure 8:
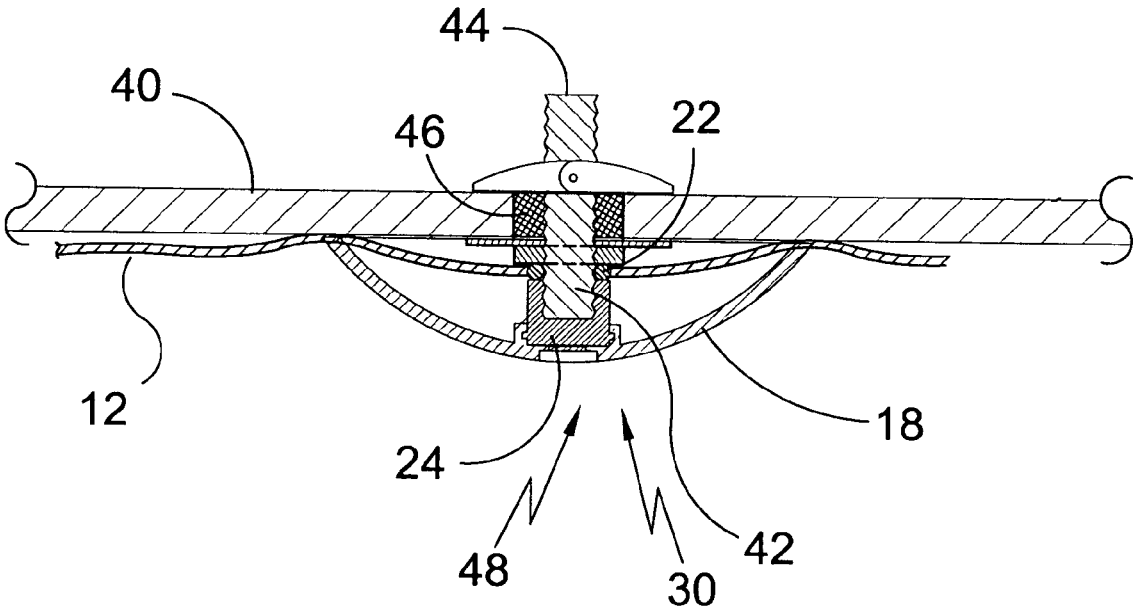
FIG. 8 is a perspective view of another embodiment of the anchor of the present invention.

Turning to FIG. 8, shown therein is a side sectional view of one of the button-like attachments 18 of the present invention. Shown is a button-like attachment 18 of the present invention used to suspend the fabric tent-like curtain 12 from a ceiling 40. A plurality of grommets 22 are positioned in apertures provided in the fabric curtain 12 at predetermined locations in the standard manner as would be done by one skilled in the art the grommets being proximate the four corners of the article being provided with the fabric-tent treatment. Strategically placed slits extending partially up the fabric 12 provides means for access to the article when completely encompassing the article, in addition to draping the fabric valance-like with tiebacks when desired. To attach the bed-tent to the ceiling, anchors or toggle bolts 44 are inserted into the ceiling 40 and fixedly positioned with appropriate washers, nuts and spacers 46 or similar fasteners resulting in a threaded support 42 depending from the ceiling whereby the grommeted 22 fabric 12 is inserted over the threaded support with the button-like attachment's rotatively threaded receiver 24 placed into engagement with the threaded support. Rotation of the post 24 receiver through the externally provided aperture 48, such as by screwdriver, threads the receiver onto the support 42 crimping the grommet 22 and fabric 12 between the ceiling 40 and decorative button-like attachment 18. Also provided is a cap 30 insertable into the attachment aperture 48 closing the aperture.

Figure 9:
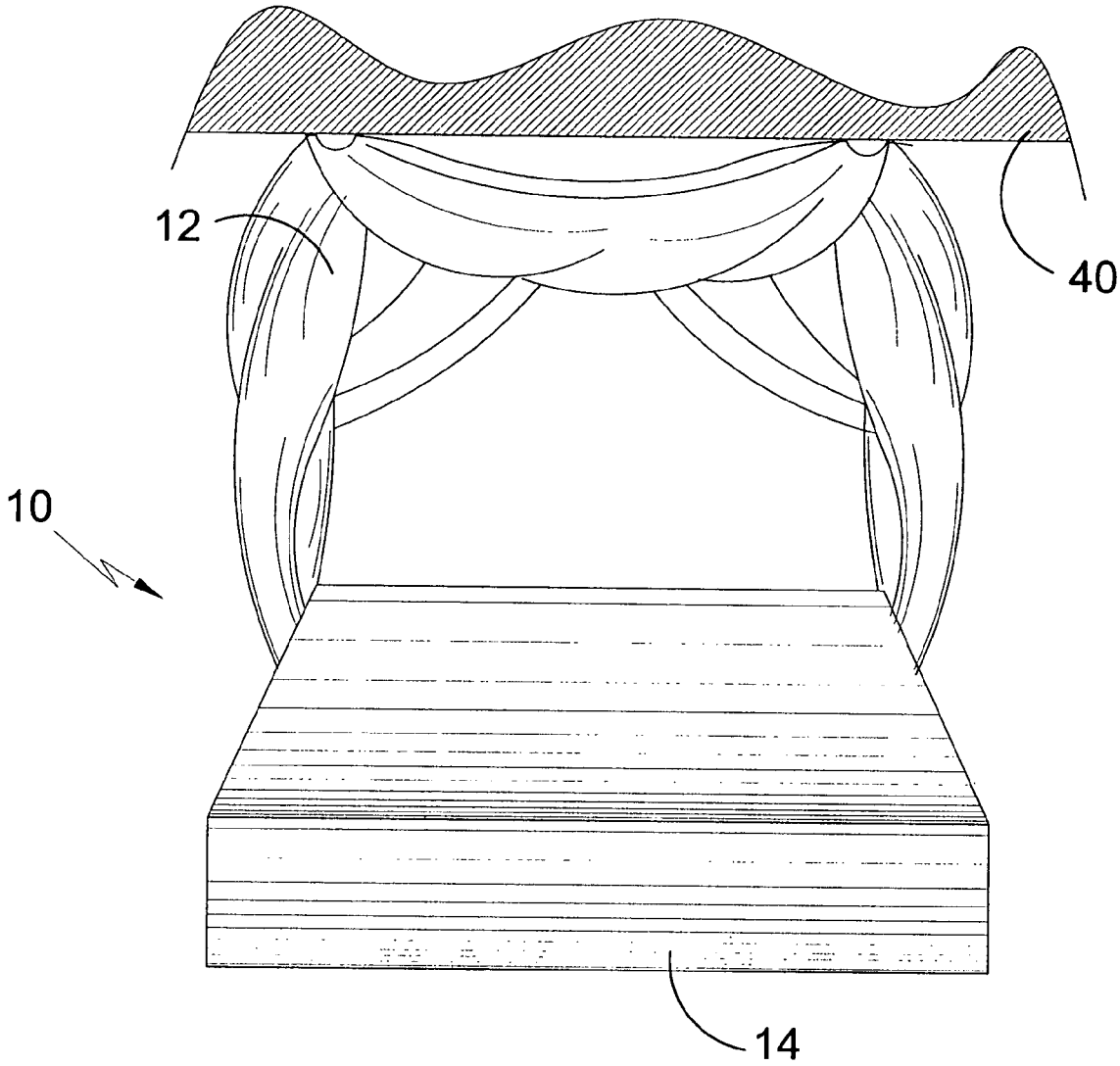
FIG. 9 is a side sectional view of the button-like attachments of the present invention.

Turning to FIG. 9, shown therein is a front perspective view of an additional element of the present invention 10. Shown is the present invention 10 having the bed-tent curtain 12 of the present invention hung by only two as opposed to the typical four points. When the present invention's 10 points of attachment are doubled up on two hanging points an aesthetic fabric backdrop is produced. Furthermore cinching the curtain 12 while in this position is achieved using desired tiebacks. Also shown are the ceiling 40 and bed 14.

Figure 10:
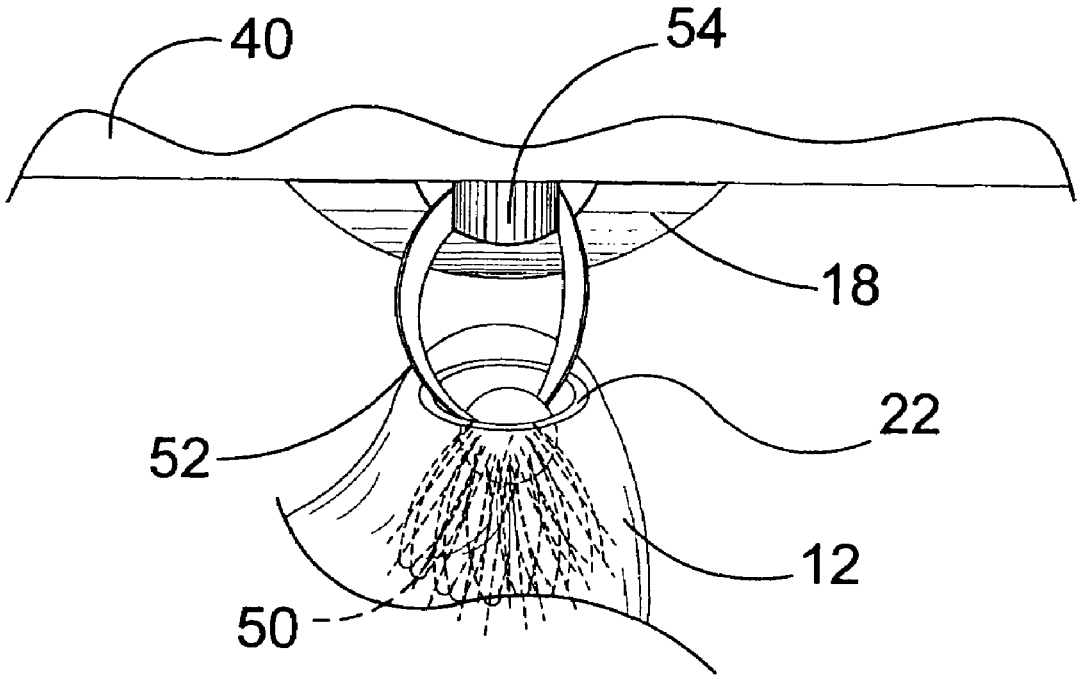
FIG. 10 is a detailed side sectional view of the button-like attachments of the present invention.

Turning to FIG. 10, shown therein is a side view of another additional element of the present invention. Shown is the button-like attachments 18 of the present invention providing a means of attachment between the bed-tent or curtain 12 and ceiling 40. Additionally a ball and tassel attachment 50 may be provided with a loop 52 for insertion of the ball and tassel through a grommet 22 provided on the bed-tent for an easy and aesthetic connection and appearance. Also shown is stem 54.

Figure 11:
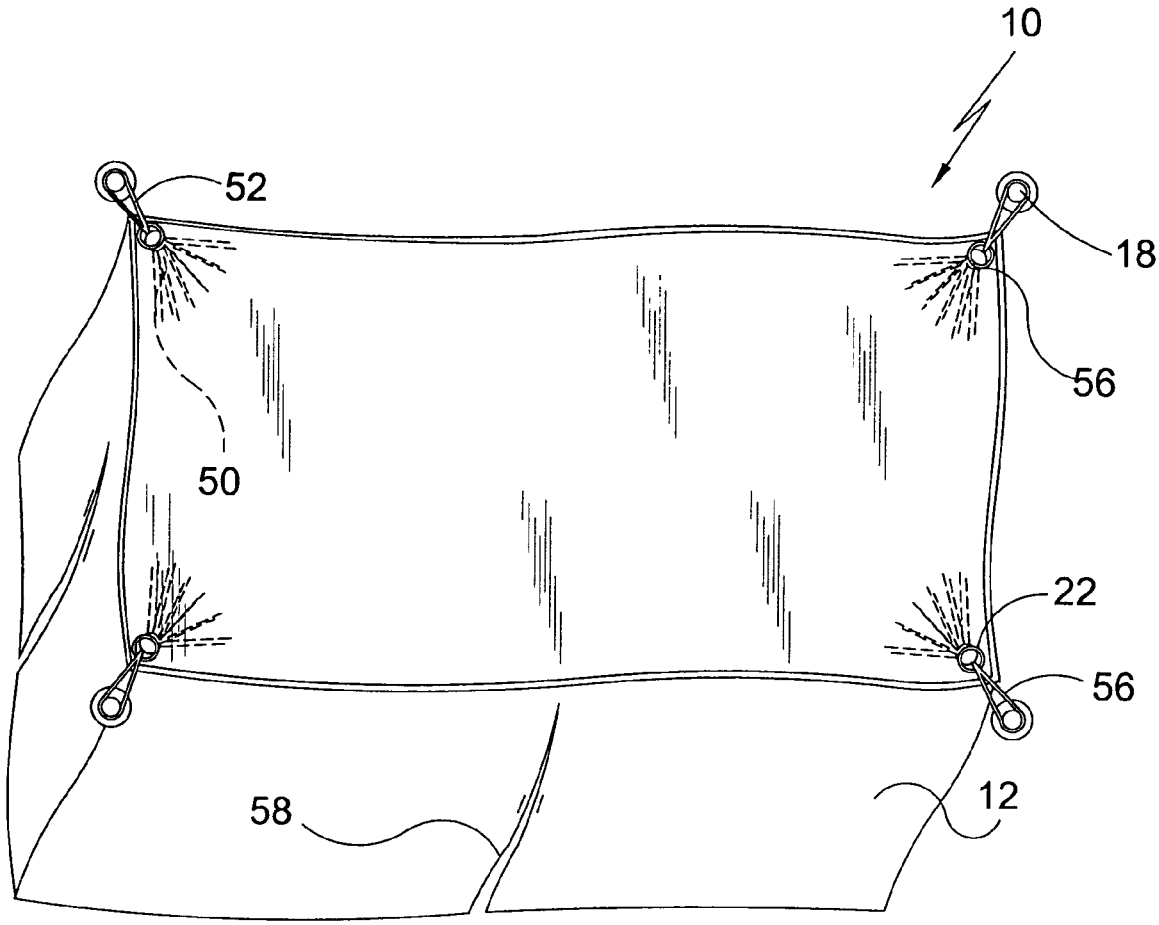
FIG. 11 is a side view of the button-like attachments and an additional element of the present invention.

Turning to FIG. 11, shown therein is a top view of an additional element of the present invention 10. Shown is a top view of the present invention 10 showing how the button like attachments 18 are placed in the ceiling at the outside proximate corners 56 of the bed to allow for the tent-like curtain 12 walls to be suspended around the periphery of the bed. Additionally shown are the grommets 22 and tassels 50 of the present invention being used as a means of attachment. Also shown are loop 52 and open seam or slit 58.

Figure 12:
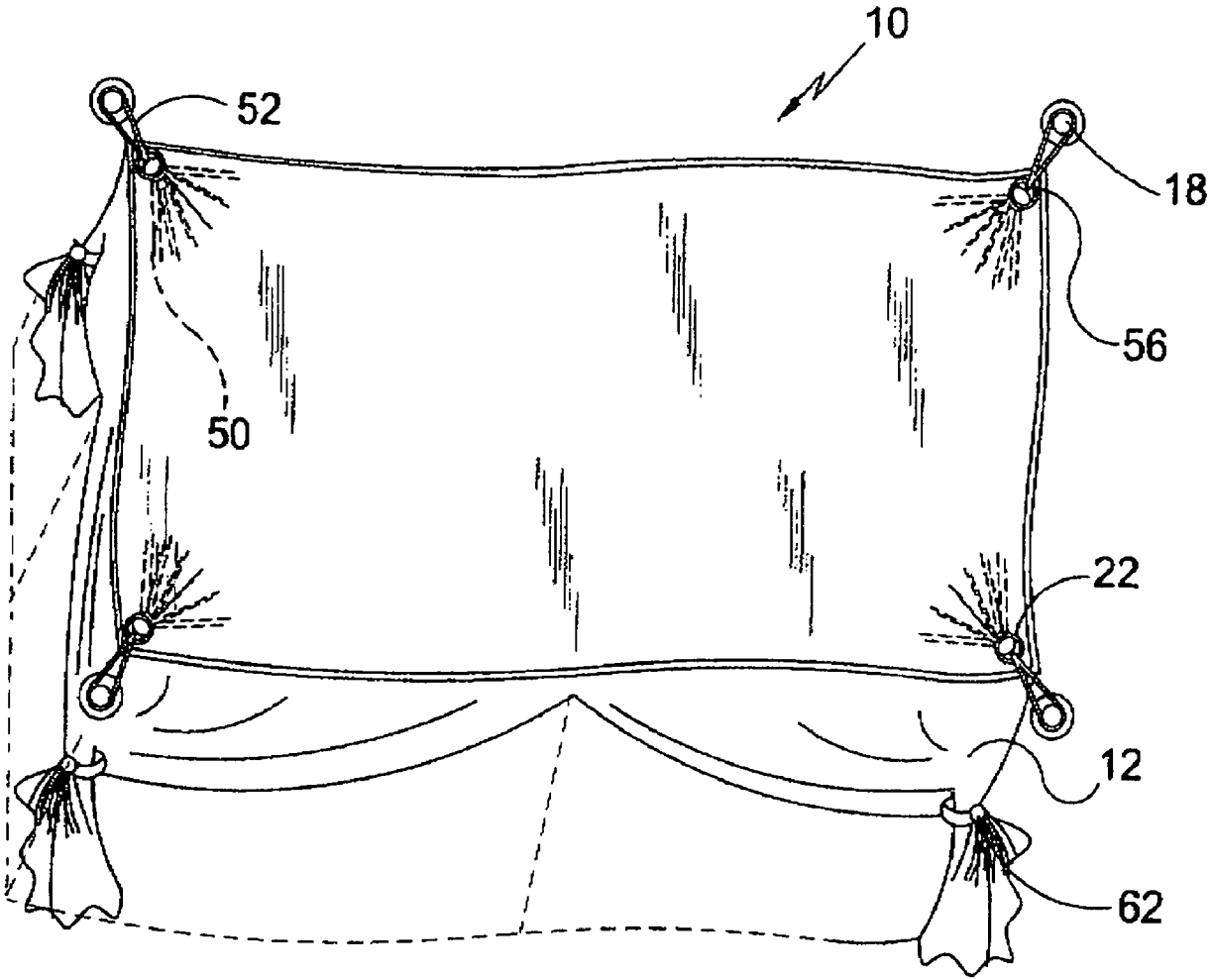
FIG. 12 is a top view of an additional element of the present invention.

Turning to FIG. 12, shown therein is a top view of an additional element of the present invention 10. Shown is a top view of the present invention 10 showing how the button-like attachments 18 are placed in the ceiling at the outside proximate corners 56 of the bed with the tent-like curtain 12 walls having centrally positioned slits 58 on all sides whereby the fabric can be drawn to the corners and cinched with tieback tassels 62. Also shown are loop 52, tassel 50, and grommet 22.

Figure 13:
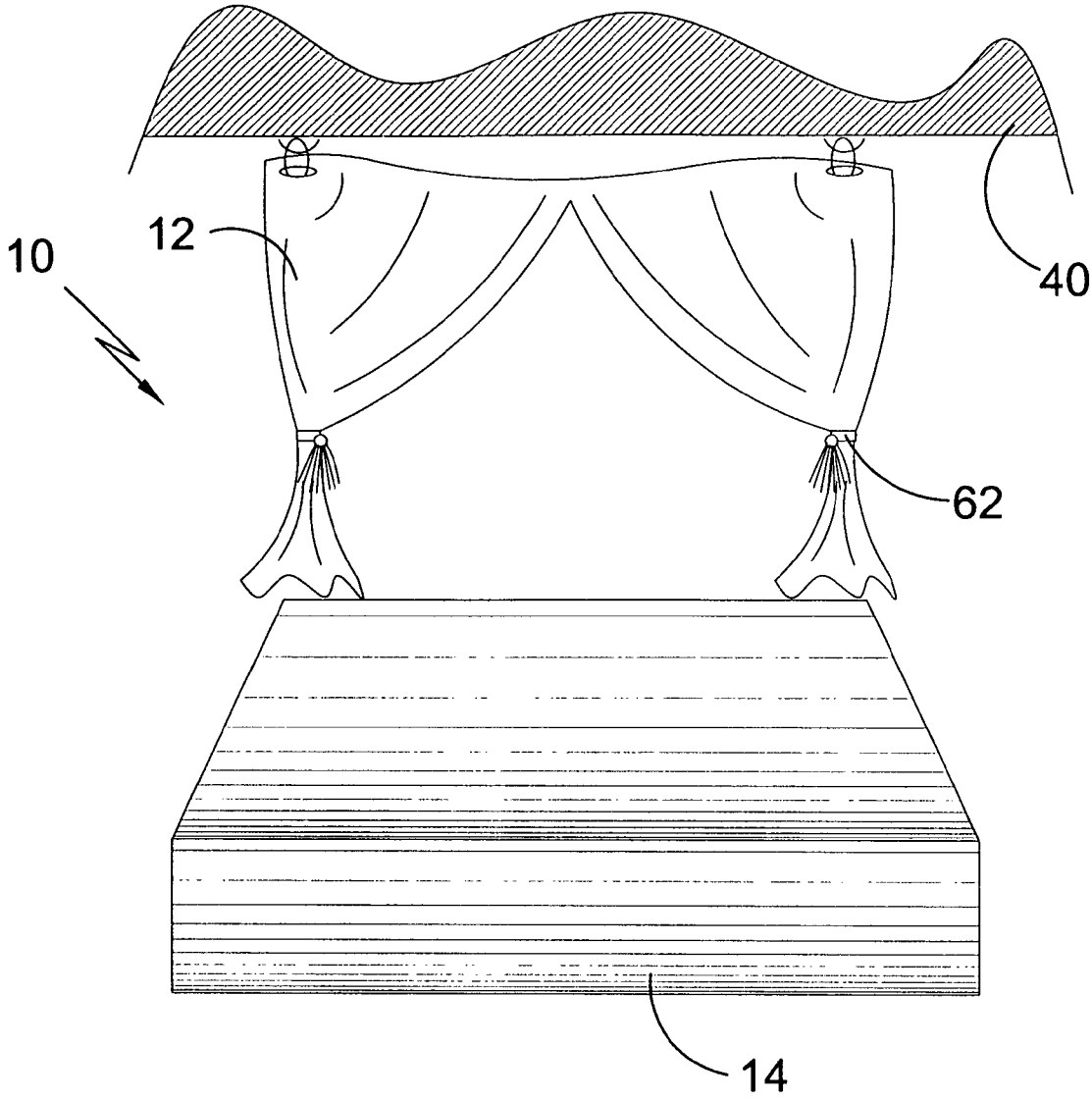
FIG. 13 is a top view of an additional element of the present invention.

Turning to FIG. 13, shown therein is a front perspective view of an additional element of the present invention 10. Shown is the present invention 10 having the bed-tent or curtain 12 of the present invention hung by only two as opposed to the typical four points. When the present invention's 10 points of attachment are doubled up on two hanging points an aesthetic fabric backdrop is produced. Furthermore cinching the fabric while in this position is achieved using tieback tassels 62. Also shown are bed 14 and ceiling 40.

I claim:

1. An apparatus for hanging a curtain from a ceiling around a bed, the bed being generally rectangular, comprising:

a) a curtain having a top, first and second long sides and first and second short sides, wherein each said top and side are generally rectangular and contiguous to each other so as to be complementary to the sides of the bed and to completely enclose the bed, wherein said top has a plurality of corners corresponding to the corners of the bed, each said corner having a first aperture therein, said first aperture having a grommet therein;

b) a plurality of attachment members being disposed on the ceiling for hanging said curtain from the ceiling, wherein one attachment member is disposed at substantially each corner of the bed, wherein each said attachment member is bowl shaped having the concave portion oriented toward the ceiling, said attachment member having upper and lower surfaces and a rim, said attachment member having a second aperture therein, said second aperture being disposed at substantially the lower most central portion of said attachment member;

c) a hollow rotative post with a threaded bore having first and second ends being upwardly disposed over and around said second aperture so that said second end is oriented toward the ceiling, said second end being open and said first end being closed by a wall, said first end wall having a slot on an outer surface thereof for receiving the head of a screwdriver therein so that said rotative post can be turned by said screwdriver, said first end having a flange trapped within a housing formed in the upper surface of said attachment member surrounding said second aperture allowing said rotative post to rotate without longitudinal movement, said post adapted for rotational connection over said aperture so that the head of the screwdriver can be inserted into said slot of said first end wall by having the tip of the screwdriver pass through said second aperture, wherein said grommet of one said corner of said curtain is disposed around said second end of one said rotative post; and, d) a threaded support having first and second ends being disposed in the ceiling substantially above the corners of the bed, wherein said first end is attached to the ceiling and said second end extends downwardly from the ceiling, wherein said second end has threads whereon which mate with said threaded bore of said rotative post so that each said grommet of said curtain is captured between said attachment member and the ceiling so that said curtain is attached to the ceiling.

2. The apparatus of claim 1, further comprising a cap for insertion into said second aperture of said attachment member so that said second aperture is covered.

3. The apparatus of claim 2, wherein said first end of said threaded support comprises wood screw threads for being fastened to a wooden member in the ceiling.

4. The apparatus of claim 3, wherein said first end of said threaded support comprises a toggle bolt for being fastened to the ceiling.

5. The apparatus of claim 4, further comprising a spacer being disposed on said threaded support.

6. The apparatus of claim 5, further comprising a washer being disposed on said threaded support.

7. The apparatus of claim 6, further comprising a nut being disposed on said threaded support.

8. The apparatus of claim 7, wherein said rim of said attachment member is contiguous to the ceiling and said threaded support is substantially perpendicular to the ceiling.

9. The apparatus of claim 8, further comprising a loop being disposed on said attachment member, a ball and tassel being disposed on said loop.

10. The apparatus of claim 9, wherein each of said sides of said curtain has a slit disposed therein so that said sides of said curtain can be tied together at each of the corners of the bed with a decorative tie-back.

11. The apparatus of claim 10, wherein each of said sides of said curtain are tied together at each of the corners at the head of the bed with a decorative tie-back.

* * * * *